US010752267B2

(12) United States Patent
Horst

(10) Patent No.: US 10,752,267 B2
(45) Date of Patent: Aug. 25, 2020

(54) RADIO BLOCKING IN A TRAIN CONTROL SYSTEM

(71) Applicant: NEW YORK AIR BRAKE, LLC, Watertown, NY (US)

(72) Inventor: Folkert Horst, Ottawa (CA)

(73) Assignee: NEW YORK AIR BRAKE, LLC, Watertown, NY (US)

( * ) Notice: Subject to any disclaimer, the term of this patent is extended or adjusted under 35 U.S.C. 154(b) by 259 days.

(21) Appl. No.: 15/933,691

(22) Filed: Mar. 23, 2018

(65) Prior Publication Data

US 2018/0273061 A1 Sep. 27, 2018

Related U.S. Application Data

(60) Provisional application No. 62/475,961, filed on Mar. 24, 2017.

(51) Int. Cl.

| | |
|---|---|
| ***B61L 3/16*** | (2006.01) |
| ***B61L 27/04*** | (2006.01) |
| ***B61L 27/00*** | (2006.01) |
| ***B61L 15/00*** | (2006.01) |
| ***B61L 25/06*** | (2006.01) |
| ***B61L 21/10*** | (2006.01) |

(Continued)

(52) U.S. Cl.

CPC ..... *B61L 3/16* (2013.01); *B61L 3/008* (2013.01); *B61L 15/0018* (2013.01); *B61L 15/0027* (2013.01); *B61L 15/0072* (2013.01); *B61L 21/10* (2013.01); *B61L 23/34* (2013.01); *B61L 25/023* (2013.01); *B61L 25/06* (2013.01); *B61L 27/0005* (2013.01); *B61L 27/0016* (2013.01); *B61L 27/0022* (2013.01); *B61L 27/0027* (2013.01); *B61L 27/0077* (2013.01); *B61L 27/04* (2013.01)

(58) Field of Classification Search

CPC ..... B61L 3/16; B61L 3/008; B61L 15/0018

See application file for complete search history.

(56) References Cited

U.S. PATENT DOCUMENTS 7,263,415 B2 * 8/2007 Mindel ..... B61L 23/34 213/1.3

8,977,414 B2 3/2015 Yamada (Continued)

OTHER PUBLICATIONS

International Search Report and Written Opinion form PCT/ISA/210 and PCT/ISA237, International Application No. PCT/US2018/023938, pp. 1-12, International Filing Date Mar. 23, 2018, dated Jul. 31, 2018.

*Primary Examiner* — Ramsey Refai

(74) *Attorney, Agent, or Firm* — Bond Schoeneck and King PLLC; David Nocilly

(57) ABSTRACT

A train control system configured to automatically execute and ensure compliance with all requirements for radio blocking. A radio blocking module of the physical train control system of a lead train retrieves and displays the appropriate clearance points for acceptance by the train driver of the lead train. Once accepted, the clearance points are transmitted to a trailing train for display and acceptance by the train driver of the trailing train. An accepted clearance point is passed to the train control system for use as the next destination point for navigation purposes. The train control system can also electronically log all acts to comply with applicable radio blocking requirements.

14 Claims, 3 Drawing Sheets

Figure 1:
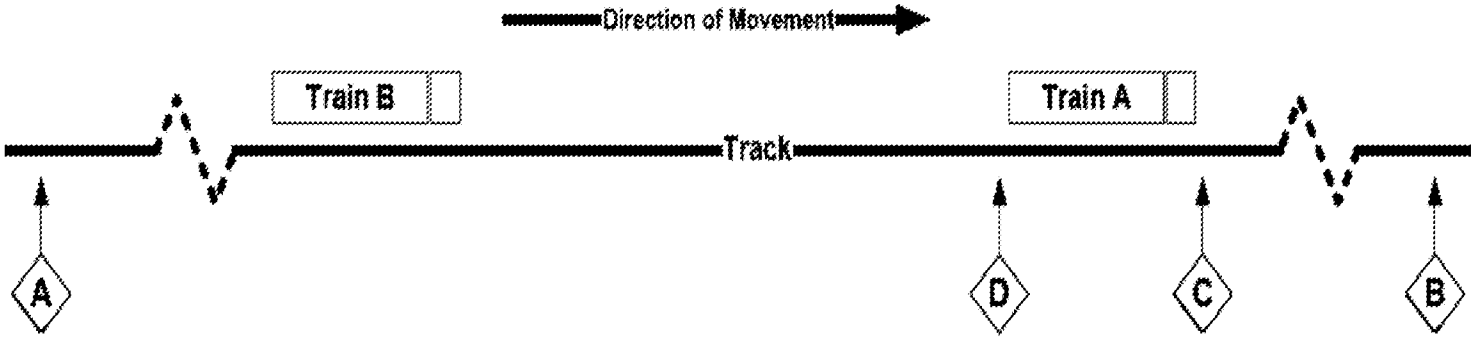

(51) Int. Cl.

| | |
|---|---|
| ***B61L 23/34*** | (2006.01) |
| ***B61L 25/02*** | (2006.01) |
| ***B61L 3/00*** | (2006.01) |

(56) References Cited

U.S. PATENT DOCUMENTS

| | | | | |
|---|---|---|---|---|
| 9,365,222 | B2 * | 6/2016 | Hawthorne | B60T 13/665 |
| 9,937,939 | B2 * | 4/2018 | Kono | B61L 25/021 |
| 2003/0120400 | A1 * | 6/2003 | Ahmed Baig | B60L 15/32 701/19 |
| 2004/0245410 | A1 * | 12/2004 | Kisak | B61L 15/0027 246/3 |
| 2011/0172856 | A1 | 7/2011 | Kull | |
| 2018/0170415 | A1 * | 6/2018 | Oswald | B61L 25/023 |

* cited by examiner

RADIO BLOCKING IN A TRAIN CONTROL SYSTEM

CROSS-REFERENCE TO RELATED APPLICATIONS

The present application claims priority to U.S. Provisional Application No. 62/475,961 filed on Mar. 24, 2017.

BACKGROUND OF THE INVENTION

1. Field of the Invention

The present invention relates to train radio blocking and, more particularly, a train control system configured to provide train blocking management and reporting.

2. Description of the Related Art

During busy time, railroads may pair trains in a non-signaled territory by giving a second train clearance to follow a lead train provided that certain conditions are met. This procedure is often referred to as "radio blocking" and involves, among other things, the second train receiving instructions from the lead train and confirming that the entire lead train has passed a specific location before the second train proceeds to that location. In addition, the special instructions that are applicable to radio blocking must be written down and retained until the end of trip.

BRIEF SUMMARY OF THE INVENTION

The present invention is a train control system configured to automatically execute and ensure compliance with all requirements for radio blocking. More specifically, the train control system of a trailing train is programmed to include a radio blocking module that can execute a trailing train "radio blocking" mode. In this radio blocking mode, the radio blocking module retrieves the appropriate clearance points, such as from a track database, which must be confirmed as cleared by a lead train prior to the training train proceeding to that point. The clearance points are visually displayed to the trailing train driver for manual selection as the lead train reports that the clearance points have been fully passed. In response to a selected clearance point, train control system can display the selected clearance point on the display and use the clearance point as a zero speed target for navigation purposes. The train control system can also electronically log the entry to comply with any applicable writing requirements. The present invention may also include a train control system configured to include a radio blocking module that is additionally programmed to execute a lead train "radio blocking" mode. In this radio blocking mode, the train control system can display the required clearance location that must be reported to the training train. As each clearance location is passed, the train control system can allow the driver to select the location that has been fully passed and reported to the trailing train to create the requisite record. Alternatively, the train control system can be configured to allow the driver to select the location that has been fully passed and then communicate that the clearance point has been passed to the train control system of the trailing locomotive.

The present invention also includes a method of implementing radio blocking, comprising the steps of providing a train control system that is programmed to include a radio blocking module in a trailing train, receiving a clearance point from a lead train that is ahead of the first train with the radio blocking module, setting the clearance point as a zero speed target in the train control system of the trailing train, and prohibiting the trailing train from proceeding to the clearance point until the lead train provides a notification that it has passed the clearance point. The method may further include the step of displaying the clearance point to a trailing driver of the trailing train. The method may also include the step of allowing the trailing driver of the trailing train to accept the clearance point after the clearance point has been displayed to the driver. The method may additionally include the step of logging the receipt of the clearance point and any acceptance of the clearance point by the trailing driver of the train. The method may also include the step of providing a second train control system having a second radio blocking module in the lead train, wherein the second train control system displays the clearance point for a lead driver of the lead train. The method may additionally include the step of allowing the trailing driver of the trailing train to accept the clearance point after the clearance point has been displayed to the trailing driver. The method may further include the step of transmitting the clearance point from the second radio blocking module of the lead train to the first radio blocking module of the trailing train if the lead driver of the lead train accepts the clearance point.

BRIEF DESCRIPTION OF THE SEVERAL VIEWS OF THE DRAWING(S)

Figure 2:
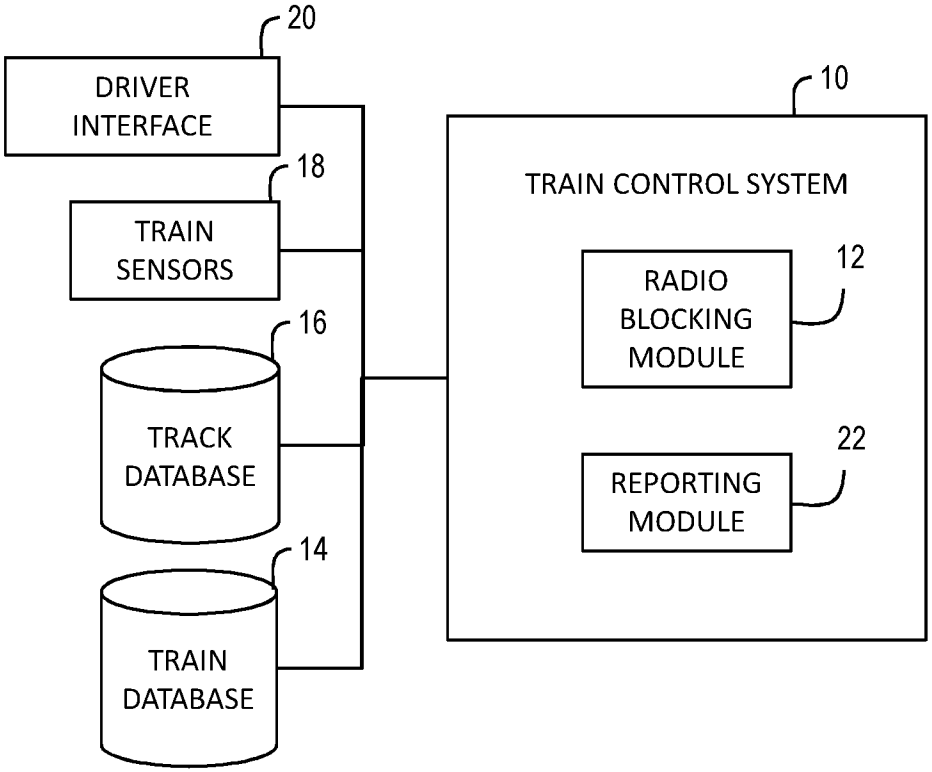
Figure 3:
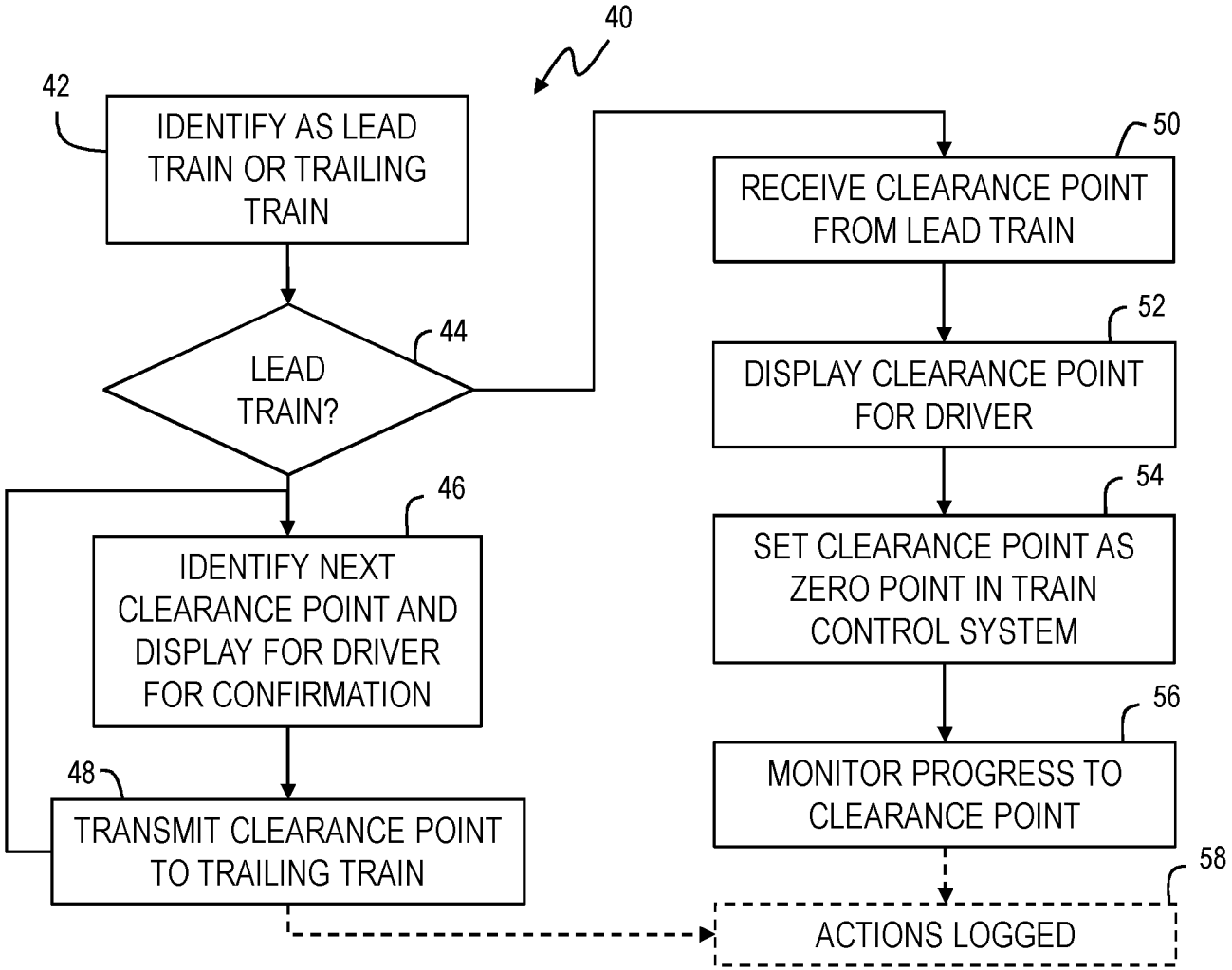

The present invention will be more fully understood and appreciated by reading the following Detailed Description in conjunction with the accompanying drawings, in which:

FIG. 1 is a schematic of a leading and a trailing train implementing radio blocking according to the present invention; and FIG. 2 is a schematic of a train control system configured for radio blocking according to the present invention; and FIG. 3 is a flowchart of a radio blocking process according to the present invention.

DETAILED DESCRIPTION OF THE INVENTION

Referring to the figures, wherein like numerals refer to like parts throughout, there is seen in FIG. 1 a lead train A and a trailing train B configured to implement radio blocking according to the present invention so that lead train A and trailing train B can be paired to traverse through a non-signaled territory and maintain a safe distance while passing clearance point D, clearance point C, and clearance point B. In response to a valid track warrant that allows both train A and train B to proceed from point A to point B, radio blocking may be implemented to ensure the safe transit of both trains. More specifically, train A leads train B and reports when it has fully passed clearance point D. When train A reports that is has full passed point D, train B has clearance to proceed to point D and train A can proceed to clearance point C, etc.

Referring to FIG. 2, train B and, optionally, train A includes a train control system 10 having a radio blocking module 12 according to the present invention. Radio blocking module 12 is programmed into train control system 10 to automate this process and ensure compliance with all applicable rules and regulations. The train control system 10 may comprise a LEADER® system available from New York Air Brake of Watertown, New York or similar train control systems 10 that is interconnected to the physical and electronic systems of the train. As is known in the art, train control system 10 includes programmable elements, such as microprocessors and microcontrollers, which implement train control software that can model train behavior and determine the forces that a train will undergo over a particular route. Train control system 10 is typically associated with a train database 14 that is hardware programmed with or incorporating information about the nature of weight of all rail cars in the train and the type of locomotives in the consist and a track database 16 that is hardware programmed with or incorporating a track profile that contains the geographic routes to be taken by the train as well as the specification information about the route, such as the elevation changes, track curvature, etc. Train control system 10 may also be associated with various train sensors 18 that detect, measure, and provide train control system 10 with operational information about the train, such as the train speed, brake pipe pressure, brake pipe pressure flow, and brake pipe pressure gradient. Train control system 10 further includes a driver interface 20 that includes the ability to display information to a train driver and accept inputs from the train driver. Train control system 10 is further programmed to include a reporting module 22 to track the various actions implemented by radio blocking module 12. For the present invention, train control system 10 is further configured to include radio blocking module 12, either through software programmed therein or specifically programmed hardware coupled to train control system 10. Train control system 10 is therefore physical structure that is specifically configured and may include programming that allows for interacts between a train and the driver of the train using hardware and programmable elements. Thus, radio blocking module 12 may comprise software running on hardware components or a combination of programmable hardware and circuitry within or coupled to train control system 10.

Referring to FIG. 3, radio blocking module 12 may be programmed to implement a radio blocking process 40. First, a train driver identifies that the particular train control system 10 will be acting as the lead train A or the trailing train B 42, such as by initiating track blocking mode of radio blocking module 12 of train control system 10 and then inputting which role the train will be playing into driver interface 20. If check 44 determines that radio blocking module 12 is acting as lead train A, train control system 10 identifies the next clearance point and displays it for the driver to confirm 46. Once confirmed, the clearance point is transmitted to the radio blocking module 12 of a train control system 10 that has been designated as a trailing train B 48. This operation may be performed manually by the driver radioing the trailing train, or electronically via synthesized voice or data message. The train speed may additionally be communicated along with the clearance point for more efficient pacing of trailing train B. If check 44 determines that radio blocking module 12 is acting as trailing train B, radio blocking module 12 looks for and receives any clearance point transmittal from lead train A 50, whether directly from lead train A or indirectly via manual input from the driver of trailing train B. The clearance point is then displayed for the driver of trailing train B 52 (with any prior clearance point cleared). The clearance point is also set in train control system 10 as a "zero speed target" 54, which means that train control system 10 would model train behavior and provide driving advice based on the assumption that the train must be stopped by that clearance point. This step can provide a fail-safe in the event that communications between train A and train B are disrupted because train B will consider the last known location of train A as a stopping point (even though train A may have actually passed the point). When adequate communications are in place, train control system 10 monitors progress of trailing train B to the next clearance point 56 to ensure that trailing train B does not proceed any further unless another clearance point is received. Additionally, all actions are logged and stored for future retrieval 58 regardless of whether train control module is acting as lead train A or trailing train B.

Clearance points used in the present invention may comprise the conventional approach of using integer marker posts. Alternatively, latitude and longitude or fractional marker posts can be sent from train A to train B, thereby avoiding the need to use discretized locations, such as integer market point, when radio blocking. In another embodiment, train control system 10 does not need to be limited to the current practice of identifying specific clearance points. For example, radio blocking module 12 may be programmed to continuously report its location (if configured for lead train A) or to continuously monitor the location of lead train B (if configured for trailing train B). As a result, the safety precautions of convention radio blocking can instead occur on a near-continuous basis, thereby improving overall safety and efficiency.

It should be recognized that the lead train A and a trailing train B configured to implement radio blocking according to the present invention may comprise any pair of trains in a series of trains. In addition, a particular train acting as trailing train B to a preceding train acting as train A may also, at the same time, serve in the capacity of a lead train A for third train that is trailing and thus acting as another train B. Thus, in a long series of trains traveling a given route, the present invention can be implemented in any number of arbitrary train pairs A and B, and in an overlapping manner where any particular pair of trains A and B may be acting in a different capacity with respect to another overlapping pair so that a particular train may be serves as both a lead train A and a trailing train B.

Thus, the present invention can improve safety by preventing a trailing train from passing a clearance point that has not been cleared by a lead train. The present invention can also be used to more efficiently navigate the train to the next clearance point, thereby saving fuel. The present invention will also serve as a reminder to the drivers of both trains of each clearance point that must be addressed and then create and can maintain the appropriate records reflecting when clearance points have been properly addressed. Finally, while system 10 can automate the laborious manual process currently required by radio blocking regulations, system 10 can also be used to increase throughput on a given rail as the distance between successive trains can be reduced while maintaining the same level of safety.

As described above, the present invention may be a system, a method, and/or a computer program associated therewith and is described herein with reference to flowcharts and block diagrams of methods and systems. The flowchart and block diagrams illustrate the architecture, functionality, and operation of possible implementations of systems, methods, and computer programs of the present invention. It should be understood that each block of the flowcharts and block diagrams can be implemented by computer readable program instructions in software, firmware, or dedicated analog or digital circuits. These computer readable program instructions may be implemented on the processor of a general purpose computer, a special purpose computer, or other programmable data processing apparatus to produce a machine that implements a part or all of any of the blocks in the flowcharts and block diagrams. Each block in the flowchart or block diagrams may represent a module, segment, or portion of instructions, which comprises one or more executable instructions for implementing the specified logical functions. It should also be noted that each block of the block diagrams and flowchart illustrations, or combinations of blocks in the block diagrams and flowcharts, can be implemented by special purpose hardware-based systems that perform the specified functions or acts or carry out combinations of special purpose hardware and computer instructions.

What is claimed is:

1. A system for implementing radio blocking, comprising:

a train control system for installation in a first train, wherein the train control system includes train sensors providing information about the operation of the first train, a track database including a track profile describing a route over which the first train will travel, and is programmed to model the operation of the first train over the route using the information about the operation of the train obtained from the train sensors, and wherein the train control system is programmed to include a first radio blocking module configured to receive a clearance point from a second train and set the clearance point as a zero speed target in the train control system so that the train control system will model the operation of the train using the zero speed target set by the first radio blocking module.

2. The system of claim 1, wherein the first radio blocking module is further configured to cause the train control system to display the clearance point to a driver of a train using a driver interface interconnected to the train control system.

3. The system of claim 2, wherein the first radio blocking module is further configured to allow the driver of the train to use the driver interface of the train control system to accept the clearance point after the clearance point has been displayed to the driver.

4. The system of claim 3, wherein the first radio blocking module is further configured to log receipt of the clearance point and any acceptance of the clearance point by the driver of the train.

5. The system of claim 4, further comprising a second train having a second train control system that is programmed to include a second radio blocking module configured to display the clearance point for a second driver of the second train using a second driver interface of the second train control system.

6. The system of claim 5, wherein the second radio blocking module is further configured to allow the second driver of the second train to accept the clearance point after the clearance point has been displayed to the second driver.

7. The system of claim 6, wherein the second radio blocking module is further configured to transmit the clearance point to the first radio blocking module of the first train if the second driver of the second train accepts the clearance point.

8. A method of implementing radio blocking, comprising the steps of:

providing a train control system having train sensors providing information about the operation of the first train, a track database including a track profile describing a route over which the first train will travel, and that is programmed to model the operation of the first train over the route using the information about the operation of the train obtained from the train sensors and to include a first radio blocking module in a trailing train;

receiving a clearance point from a lead train that is ahead of the trailing train with the first radio blocking module;

setting the clearance point as a zero speed target in the train control system of the trailing train so that the train control system models the operation of the train using the zero speed target set by the first radio blocking module; and using the train control system to prohibit the trailing train from proceeding to the clearance point until the lead train provides a notification that it has passed the clearance point.

9. The method of claim 8, further comprising the step of displaying the clearance point to a trailing driver of the trailing train.

10. The method of claim 9, further comprising the step of allowing the trailing driver of the trailing train to accept the clearance point after the clearance point has been displayed to the trailing driver.

11. The method of claim 10, further comprising the step of logging the receipt of the clearance point and any acceptance of the clearance point by the trailing driver of the trailing train.

12. The method of claim 11, further comprising the step of providing a second train control system having a second radio blocking module in the lead train, wherein the second train control system displays the clearance point for a lead driver of the lead train.

13. The method of claim 12, further comprising the step of allowing the trailing driver of the trailing train to accept the clearance point after the clearance point has been displayed to the trailing driver.

14. The method of claim 13, further comprising the step of transmitting the clearance point from the second radio blocking module of the lead train to the first radio blocking module of the trailing train if the lead driver of the lead train accepts the clearance point.

* * * * *